US007575062B2

(12) United States Patent
East, Jr.

(10) Patent No.: US 7,575,062 B2
(45) Date of Patent: Aug. 18, 2009

(54) METHODS AND DEVICES FOR TREATING MULTIPLE-INTERVAL WELL BORES

(75) Inventor: Loyd East, Jr., Tomball, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 189 days.

(21) Appl. No.: 11/746,656

(22) Filed: May 10, 2007

(65) Prior Publication Data

US 2008/0156496 A1 Jul. 3, 2008

Related U.S. Application Data

(63) Continuation-in-part of application No. 11/450,654, filed on Jun. 9, 2006, now Pat. No. 7,478,676.

(51) Int. Cl.
*E21B 34/14* (2006.01)
*E21B 33/12* (2006.01)
*E21B 43/26* (2006.01)

(52) U.S. Cl. ..... 166/386; 166/305.1; 166/308.1; 166/332.4; 166/334.4; 166/332.1; 166/387

(58) Field of Classification Search ..... 166/332.1, 166/332.4, 334.4, 388, 387, 305.1, 308.1
See application file for complete search history.

(56) References Cited

U.S. PATENT DOCUMENTS 2,725,107 A * 11/1955 Abendroth et al. ..... 166/51
3,361,204 A 1/1968 Howard
4,919,989 A 4/1990 Colangelo ..... 428/66.4
4,936,386 A 6/1990 Colangelo ..... 166/292

(Continued)

FOREIGN PATENT DOCUMENTS

EP 1 407 133 B1 3/2006

(Continued)

OTHER PUBLICATIONS

Foreign communication related to counterpart application dated Jun. 15, 2007.

(Continued)

*Primary Examiner*—Giovanna C Wright
(74) *Attorney, Agent, or Firm*—John W. Wustenberg; Baker Botts, LLP

(57) ABSTRACT

Methods and devices are provided for treating multiple interval well bores. More particularly, an isolation assembly may be used to allow for zonal isolation to allow treatment of selected productive or previously producing intervals in multiple interval well bores. One example of a method for treating a multiple interval well bore includes the steps of: introducing an isolation assembly to a well bore, the isolation assembly comprising a liner, one or more sleeves and a plurality of swellable packers, wherein the sleeves and swellable packers are disposed about the liner; deploying a shifting tool inside the liner, where the sleeves are configured so as to provide open, closed and open to screen positions when actuated by the shifting tool. An open position allows for treatment of the well bore while an open to screen position allows for receiving fluid from the well bore. A closed position re-establishes zonal isolation.

18 Claims, 12 Drawing Sheets

U.S. PATENT DOCUMENTS

| | | | | |
|---|---|---|---|---|
| 4,949,788 | A | 8/1990 | Szarka et al. | |
| 5,048,605 | A | 9/1991 | Toon | 166/187 |
| 5,263,683 | A | 11/1993 | Wong | |
| 5,325,917 | A | 7/1994 | Szarka | |
| 5,381,862 | A | 1/1995 | Szarka et al. | |
| 5,474,131 | A | 12/1995 | Jordan, Jr. et al. | |
| 5,657,822 | A | 8/1997 | James et al. | 166/292 |
| 5,779,787 | A | 7/1998 | Brothers et al. | 106/802 |
| 5,810,085 | A | 9/1998 | James et al. | 166/292 |
| 6,044,908 | A | 4/2000 | Wyatt | |
| 6,431,282 | B1 | 8/2002 | Bosma et al. | 166/288 |
| 6,464,006 | B2 | 10/2002 | Womble | |
| 6,518,224 | B2 | 2/2003 | Wood | 507/118 |
| 6,644,412 | B2 * | 11/2003 | Bode et al. | 166/373 |
| 6,675,893 | B2 * | 1/2004 | Lund | 166/278 |
| 6,834,725 | B2 | 12/2004 | Whanger et al. | 166/384 |
| 6,840,325 | B2 | 1/2005 | Stephenson | 166/380 |
| 6,848,505 | B2 | 2/2005 | Richard et al. | 166/285 |
| 6,854,522 | B2 | 2/2005 | Brezinski et al. | 166/387 |
| 6,907,937 | B2 | 6/2005 | Whanger et al. | 166/387 |
| 6,976,542 | B2 | 12/2005 | Henriksen et al. | 166/386 |
| 7,036,587 | B2 | 5/2006 | Munoz, Jr. et al. | 166/279 |
| 7,063,164 | B2 * | 6/2006 | Hilsman et al. | 166/387 |
| 2002/0104650 | A1 | 8/2002 | Dusterhoft et al. | 166/227 |
| 2004/0020662 | A1 | 2/2004 | Freyer | 166/387 |
| 2004/0123983 | A1 | 7/2004 | Cook et al. | 166/50 |
| 2004/0194971 | A1 | 10/2004 | Thomson | 166/387 |
| 2005/0061508 | A1 | 3/2005 | Surjaatmadja | |
| 2005/0092485 | A1 | 5/2005 | Brezinski et al. | 166/207 |
| 2005/0110217 | A1 | 5/2005 | Wood et al. | 277/333 |
| 2005/0113260 | A1 | 5/2005 | Wood | 507/117 |
| 2005/0167109 | A1 | 8/2005 | Hepburn et al. | 166/313 |
| 2005/0173130 | A1 | 8/2005 | Richard | 166/384 |
| 2005/0199401 | A1 | 9/2005 | Patel et al. | 166/387 |
| 2005/0205263 | A1 | 9/2005 | Richard | 166/369 |
| 2005/0241831 | A1 | 11/2005 | Steele et al. | 166/313 |
| 2005/0252651 | A1 | 11/2005 | Bosma et al. | 166/51 |
| 2006/0124310 | A1 | 6/2006 | Cardenas et al. | 166/313 |

FOREIGN PATENT DOCUMENTS

| | | | |
|---|---|---|---|
| GB | 2414259 | A | 11/2005 |
| GB | 2414495 | A | 11/2005 |
| WO | WO-02/059452 | A1 | 8/2002 |
| WO | WO-02/090714 | A1 | 11/2002 |
| WO | WO-03/008756 | A1 | 1/2003 |
| WO | WO 03/064811 | A2 | 8/2003 |
| WO | WO 03/064811 | A3 | 8/2003 |
| WO | WO-2004/027209 | A1 | 4/2004 |
| WO | WO-2004/057715 | A2 | 7/2004 |
| WO | WO-2004/072439 | A1 | 8/2004 |
| WO | WO-2005/031111 | A1 | 4/2005 |
| WO | WO 2005/090741 | | 9/2005 |
| WO | WO 2005/090741 | A1 | 9/2005 |
| WO | WO 2005100743 | A1 * | 10/2005 |
| WO | WO 2007/126496 | A3 | 11/2007 |
| WO | WO2007/141465 | A1 | 12/2007 |

OTHER PUBLICATIONS

International Search Report for International Application No. PCT/GB2007/001025.

Coon, et al., "Single-Trip Completion Concept Replaces Multiple Packers and Sliding Sleeves in Selective Multi-Zone Production and Stimulation Operations," Society of Petroleum Engineers, SPE 29539, 911-915.

* cited by examiner

METHODS AND DEVICES FOR TREATING MULTIPLE-INTERVAL WELL BORES

CROSS-REFERENCE TO RELATED APPLICATIONS

This application is a continuation in part of U.S. patent application Ser. No. 11/450,654 filed on Jun. 9, 2006 now U.S. Pat. No. 7,478,676 which is hereby incorporated by reference as if fully reproduced herein.

FIELD OF INVENTION

The present invention relates to methods and devices for treating multiple interval well bores and more particularly, the use of an isolation assembly to provide zonal isolation to allow selected treatment of productive or previously producing intervals in multiple interval well bores.

BACKGROUND

Oil and gas wells often produce hydrocarbons from more than one subterranean zone or well bore interval. Occasionally, it is desired to treat or retreat one or more intervals of a well bore. Reasons for treating or retreating intervals of a well bore include the need to stimulate or restimulate an interval as a result of declining productivity during the life of the well. Examples of stimulation treatments include fracturing treatments and acid stimulation. Other treating operations include conformance treatments, sand control treatments, blocking or isolating intervals, consolidating treatments, sealing treatments, or any combination thereof.

One difficulty in treating a selected interval of an already producing well bore is the lack of zonal isolation between intervals. That is, each of the selected intervals to be treated may be in fluid communication with other intervals of the well bore. This lack of isolation between intervals can prevent targeted treatments to selected intervals because treatments intended for one selected interval may inadvertently flow into a nonintended interval. Thus, before treating or retreating a selected interval of a well bore, the selected interval will often be isolated from the other intervals of the well bore. In this way, treatments may be targeted to specific intervals.

Conventional methods for reisolation of well bore intervals include the use of isolation devices such as, for example, straddle packers, packers with sand plugs, packers with bridge plugs, isolation via cementing, and combinations thereof. Such conventional methods, however, can suffer from a number of disadvantages including lower rate throughputs due to additional well bore restrictions inherent in such methods, poor isolation between intervals, and depletion between intervals.

Thus, a need exists for an improved method for providing isolation between well bore intervals to allow treatment or retreatment of selected intervals in multiple interval well bores.

SUMMARY

The present invention relates to methods and devices for treating multiple interval well bores and more particularly, the use of an isolation assembly to provide zonal isolation to allow selected treatment of productive or previously producing intervals in a multiple interval well bore.

One example of a method for multi-interval fracturing completion comprises the steps of: introducing an isolation assembly to a well bore, the isolation assembly comprising a liner, one or more sleeves, one or more screen-wrapped sleeves and a plurality of swellable packers, wherein the plurality of swellable packers are disposed around the liner at one or more selected spacings; swelling at least one of the plurality of swellable packers so as to provide zonal isolation one or more selected intervals; wherein the one or more sleeves and the one or more screen-wrapped sleeves are disposed around the liner at selected spacings so as to provide at least one of the one or more sleeves and at least one of the one or more screen-wrapped sleeves within at least one of the one or more selected intervals; deploying a shifting tool inside the liner, wherein the shifting tool is adapted to adjust positioning of each of the one or more sleeves and each of the one or more screen-wrapped sleeves; actuating the shifting tool to adjust positioning of the at least one of the one or more sleeves to an open position so as to stimulate the at least one of the one or more selected intervals by flowing fluid through one or more openings of the liner and through one or more openings in the at least one of the one or more sleeves; actuating the shifting tool to adjust positioning of the at least one of the one or more sleeves to a closed position so as to reestablish zonal isolation of the at least one of the one or more selected intervals; and actuating the shifting tool to adjust positioning of the at least one of the one or more screen-wrapped sleeves to an open position so as to allow flow of production fluid from the at least one of the one or more selected intervals through one or more openings in the liner and through a plurality of openings in the at least one of the one or more screen-wrapped sleeves.

Another example of a method for multi-interval fracturing completion comprises the steps of: introducing an isolation assembly to a well bore, the isolation assembly comprising a liner, one or more sleeves and a plurality of swellable packers, wherein the plurality of swellable packers are disposed around the liner at one or more selected spacings; swelling at least one of the plurality of swellable packers so as to provide zonal isolation of one or more selected intervals; wherein the one or more sleeves are disposed around the liner at selected spacings so as to provide at least one of the one or more sleeves within at least one of the one or more selected intervals and wherein the one or more sleeves are configured so as to provide a closed position, an open position and an open to screen position; actuating the shifting tool to adjust positioning of the at least one of the one or more sleeves to an open position; pumping fluid through one or more openings in the liner and through one or more openings of the at least one of the one or more sleeves within the at least one of the one or more selected intervals so as to stimulate the at least one of the one or more selected intervals; actuating the shifting tool to adjust positioning of the at least one of the one or more sleeves to an open to screen position so as to allow flow of production fluid from the at least one of the one or more selected intervals through one or more openings in the liner and through one or more openings in the at least one of the one or more sleeves.

An example isolation assembly tool adapted to provide multi-interval fracturing completion comprises: a liner; one or more sleeves, wherein the one or more sleeves are disposed around the liner; one or more screen-wrapped sleeves, wherein the one or more screen-wrapped sleeves are disposed around the liner, wherein the one or more sleeves and the one or more screen-wrapped sleeves are disposed around the liner at selected spacings and wherein a shifting tool is adapted to adjust positioning of each of the one or more sleeves and each of the one or more screen-wrapped sleeves to an open position and a closed position.

Another example isolation assembly tool adapted to provided multi-interval fracturing completion comprises: a liner; one or more sleeves, wherein the one or more sleeves are disposed around the liner; wherein a shifting tool is adapted to adjust positioning of each of the one or more sleeves to an open position, a closed position and an open to screen position and wherein a shifting tool is adapted to adjust positioning of each of the one or more sleeves to an open position, a closed position and an open to screen position and wherein the one or more sleeves is disposed around the liner at selected spacing to cover selected perforations of the liner.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

The present invention relates to methods and devices for treating multiple interval well bores and more particularly, the use of an isolation assembly to provide zonal isolation to allow selected treatment of productive or previously producing intervals in a multiple interval well bore.

The methods and devices of the present invention may allow for reestablishing zonal isolation of producing intervals, bypassed, or non-producing intervals, or previously producing intervals in multiple interval well bores through the use of an isolation assembly. In certain embodiments, isolation assemblies of the present invention may comprise a liner and a plurality of swellable packers, the swellable packers being disposed about the liner at selected spacings.

To facilitate a better understanding of the present invention, the following examples of certain embodiments are given. In no way should the following examples be read to limit, or define, the scope of the invention.

Figure 1A:
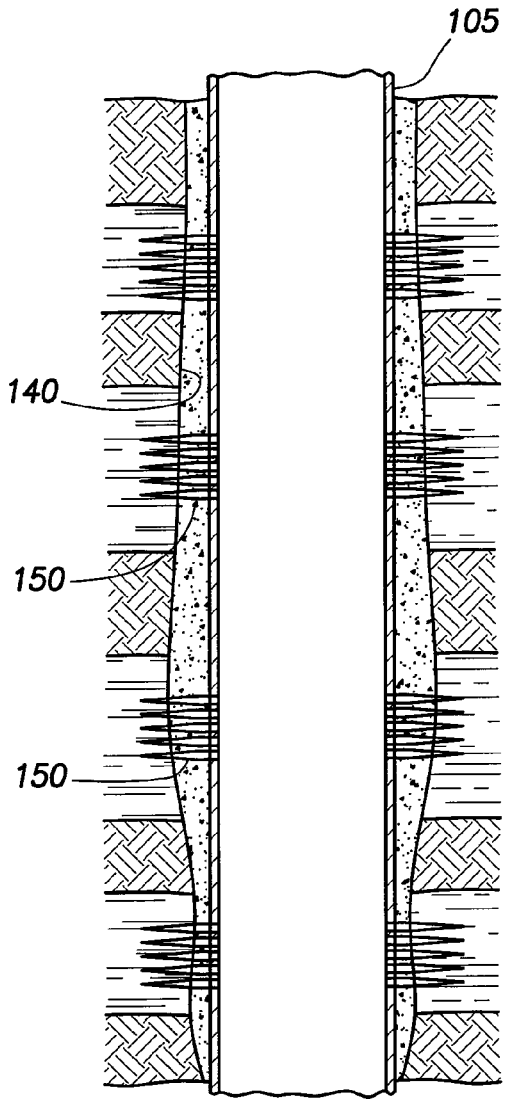
FIG. 1A (PRIOR ART)
FIG. 1A illustrates a well bore having a casing string disposed therein.

FIG. 1A illustrates a typical well bore completion. In FIG. 1, casing string 105 is disposed in well bore 140. Perforations 150 through casing string 105 permit fluid communication through casing string 105. In such a completion, treating or retreating a specific interval may be problematic, because each interval is no longer isolated from one another. To address this problem, FIG. 1B shows one embodiment of an apparatus for reestablishing isolation of previously unisolated well bore intervals of a longitudinal portion of a well bore.

Figure 1B:
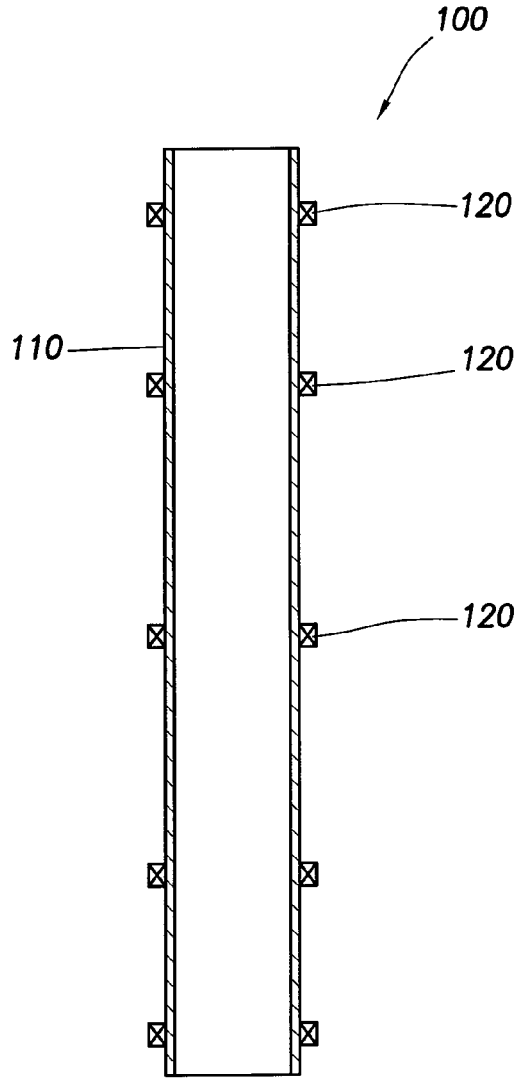
FIG. 1B illustrates a cross-sectional view of an isolation assembly comprising a liner and a plurality of swellable packers, the plurality of swellable packers being disposed about the liner at selected spacings in accordance with one embodiment of the present invention.

In particular, FIG. 1B illustrates a cross-sectional view of isolation assembly 100 comprising liner 110 and plurality of swellable packers 120. Plurality of swellable packers 120 may be disposed about the liner at selected spacings.

In certain embodiments, liner 110 may be installed permanently in a well bore, in which case, liner 110 may be made of any material compatible with the anticipated downhole conditions in which liner 110 is intended to be used. In other embodiments, liner 110 may be temporary and may be made of any drillable or degradable material. Suitable liner materials include, but are not limited to, metals known in the art (e.g. aluminum, cast iron), various alloys known in the art (e.g. stainless steel), composite materials, degradable materials, or any combination thereof. The terms "degradable," "degrade," "degradation," and the like, as used herein, refer to degradation, which may be the result of, inter alia, a chemical or thermal reaction or a reaction induced by radiation. Degradable materials include, but are not limited to dissolvable materials, materials that deform or melt upon heating such as thermoplastic materials, hydralytically degradable materials, materials degradable by exposure to radiation, materials reactive to acidic fluids, or any combination thereof. Further examples of suitable degradable materials are disclosed in U.S. Pat. No. 7,036,587, which is herein incorporated by reference in full.

Swellable packers 120 may be any elastomeric sleeve, ring, or band suitable for creating a fluid tight seal between liner 110 and an outer tubing, casing, or well bore in which liner 110 is disposed. Suitable swellable packers include, but are not limited, to the swellable packers disclosed in U.S. Publication No. 2004/0020662, which is herein incorporated by reference in full.

It is recognized that each of the swellable packers 120 may be made of different materials, shapes, and sizes. That is, nothing herein should be construed to require that all of the swellable packers 120 be of the identical material, shape, or size. In certain embodiments, each of the swellable packers 120 may be individually designed for the conditions anticipated at each selected interval, taking into account the expected temperatures and pressures for example. Suitable swellable materials include ethylene-propylene-copolymer rubber, ethylene-propylene-diene terpolymer rubber, butyl rubber, halogenated butyl rubber, brominated butyl rubber, chlorinated butyl rubber, chlorinated polyethylene, styrene butadiene, ethylene propylene monomer rubber, natural rubber, ethylene propylene diene monomer rubber, hydragenized acrylonitrile-butadiene rubber, isoprene rubber, chloroprene rubber, and polynorbornene. In certain embodiments, only a portion of the swellable packer may comprise a swellable material.

Figure 2:
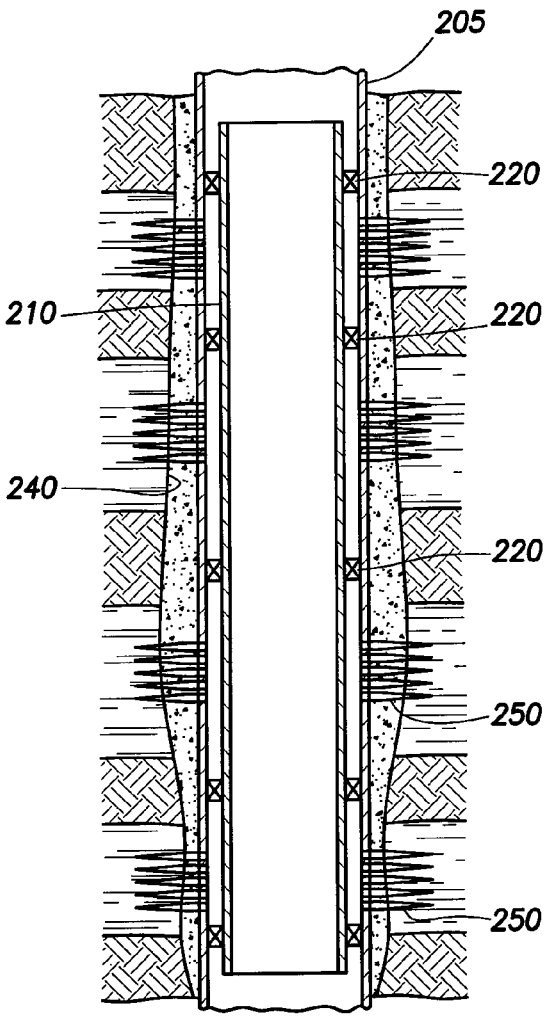
FIG. 2 illustrates a cross-sectional view of an isolation assembly in a well bore providing isolation of selected intervals of a well bore in accordance with one embodiment of the present invention.

FIG. 2 illustrates a cross-sectional view of isolation assembly 200 disposed in casing string 205 of well bore 240 for reestablishing isolation of previously unisolated well bore intervals. Although well bore 240 is depicted here as a vertical well, it is recognized that isolation assembly 200 may be used in horizontal and deviated wells in addition to vertical wells. Additionally, it is expressly recognized that isolation assembly 200 may extend the entire length of well bore 240 (i.e., effectively isolating the entire casing string) or only along a longitudinal portion of well bore 240 as desired. Additionally, isolation assembly 200 may be formed of one section or multiple sections as desired. In this way, isolation may be provided to only certain longitudinal portions of the well bore. In certain embodiments, isolation assembly 200 may be a stacked assembly.

As is evident from FIG. 2, casing string 205 has perforations 250, which allow fluid communication to each of the perforated intervals along the well bore. The isolation assembly (i.e. liner 210 and swellable packers 220) may be introduced into casing string 210.

The swelling of plurality of swellable packers 220 may cause an interference fit between liner 210 and casing string 205 so as to provide fluidic isolation between selected intervals along the length of the well bore. The fluidic isolation may provide zonal isolation between intervals that were previously not fluidly isolated from one another. In this way, integrity of a previously perforated casing may be reestablished. That is, the isolation assembly can reisolate intervals from one another as desired. By reestablishing the integrity of the well bore in this way, selected intervals may be treated as desired as described more fully below.

The swelling of the swellable packers may be initiated by allowing a reactive fluid, such as for example, a hydrocarbon to contact the swellable packer. In certain embodiments, the swelling of the swellable packers may be initiated by spotting the reactive fluid across the swellable packers with a suitable fluid. The reactive fluid may be placed in contact with the swellable material in a number of ways, the most common being placement of the reactive fluid into the well bore prior to installing the liner. The selection of the reactive fluid depends on the composition of the swellable material as well as the well bore environment. Suitable reaction fluids include any hydrocarbon based fluids such as crude oil, natural gas, oil based solvents, diesel, condensate, aqueous fluids, gases, or any combination thereof. U.S. Publication No. 2004/0020662 describes a hydrocarbon swellable packer, and U.S. Pat. No. 4,137,970 describes a water swellable packer, both of which are hereby incorporated by reference. Norwegian Patent 20042134, which is hereby incorporated by reference, describes a swellable packer, which expands upon exposure to gas. The spotting of the swellable packers may occur before, after, or during the introduction of the isolation assembly into the well bore. In some cases, a reservoir fluid may be allowed to contact the swellable packers to initiate swelling of the swellable packers.

After fluidic isolation of selected intervals of the well bore has been achieved, fluidic connectivity may be established to selected intervals of the well bore. Any number of methods may be used to establish fluidic connectivity to a selected interval including, but not limited to, perforating the liner at selected intervals as desired.

Selected intervals may then be treated with a treatment fluid as desired. Selected intervals may include bypassed intervals sandwiched between previously producing intervals and thus packers should be positioned to isolate this interval even though the interval may not be open prior to the installation of liner 210. Further, packers may be positioned to isolate intervals that will no longer be produced such as intervals producing excessive water.

As used herein, the terms "treated," "treatment," "treating," and the like refer to any subterranean operation that uses a fluid in conjunction with a desired function and/or for a desired purpose. The terms "treated," "treatment," "treating," and the like as used herein, do not imply any particular action by the fluid or any particular component thereof. In certain embodiments, treating of a selected interval of the well bore may include any number of subterranean operations including, but not limited to, a conformance treatment, a consolidation treatment, a sand control treatment, a sealing treatment, or a stimulation treatment to the selected interval. Stimulation treatments may include, for example, fracturing treatments or acid stimulation treatments.

Figure 3A:
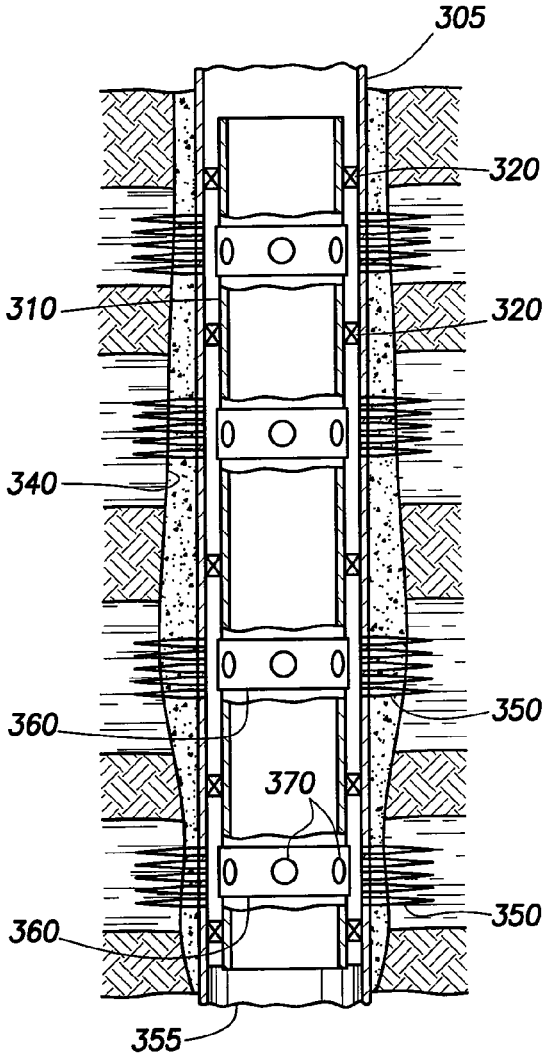
FIG. 3A illustrates a cross-sectional view of an isolation assembly in a well bore providing isolation of selected intervals of a well bore showing certain optional features in accordance with one embodiment of the present invention.

FIG. 3A illustrates a cross-sectional view of an isolation assembly in a well bore providing isolation of selected intervals of a well bore showing certain optional features in accordance with one embodiment of the present invention.

Liner 310 may be introduced into well bore 340 by any suitable method for disposing liner 310 into well bore 340 including, but not limited to, deploying liner 310 with jointed pipe or setting with coiled tubing. If used, any liner hanging device may be sheared so as to remove the coiled tubing or jointed pipe while leaving the previously producing intervals isolated. Optionally, liner 340 can include a bit and scraper run on the end of the liner for the purpose of removing restrictions in the casing while running liner 310. In certain embodiments, liner 310 may be set on the bottom of well bore 340 until swellable packers 320 have swollen to provide an interference fit or fluidic seal sufficient to hold liner 310 in place. Alternatively, liner 310 may set on bridge plug 355 correlated to depth, or any suitable casing restriction of known depth. Here, liner 305 is depicted as sitting on bridge plug 355, which may be set via a wireline. In this way, bridge plug 355 may serve as a correlation point upon which liner 310 is placed when it is run into the casing. In certain embodiments, liner 310 may a full string of pipe to the surface, effectively isolating the entire casing string 310, or in other embodiments, liner 310 may only isolate a longitudinal portion of casing string 310.

As previously described, once liner 310 is in place and the swellable packers have expanded to provide fluidic isolation between the intervals, selected intervals may be isolated and perforated as desired to allow treatment of the selected intervals. Any suitable isolation method may be used to isolate selected intervals of the liner including, but not limited to, a ball and baffle method, packers, nipple and slickline plugs, bridge plugs, sliding sleeves, particulate or proppant plugs, or any combination thereof.

Before treatment of selected intervals, liner 310 may be perforated to allow treating of one or more selected intervals. The term "perforated" as used herein means that the member or liner has holes or openings through it. The holes can have any shape, e.g. round, rectangular, slotted, etc. The term is not intended to limit the manner in which the holes are made, i.e. it does not require that they be made by perforating, or the arrangement of the holes.

Any suitable method of perforating liner 310 may be used to perforate liner 310 including but not limited to, conventional perforation such as through the use of perforation charges, preperforated liner, sliding sleeves or windows, frangible discs, rupture disc panels, panels made of a degradable material, soluble plugs, perforations formed via chemical cutting, or any combination thereof. In certain embodiments, a hydrajetting tool may be used to perforate the liner. In this way, fluidic connectivity may be reestablished to each selected interval as desired. Here, in FIG. 3A, sliding sleeves 360 may be actuated to reveal liner perforations 370. Liner perforations 370 may be merely preinstalled openings in liner 310 or openings created by either frangible discs, degradation of degradable panels, or any other device suitable for creating an opening in liner 310 at a desired location along the length of liner 310.

In certain embodiments, sliding sleeves 360 may comprise a fines mitigation device such that sliding sleeve 360 may function so as to include an open position, a closed position, and/or a position that allows for a fines mitigation device such as a sand screen or a gravel pack to reduce fines or proppant flowback through the aperture of sliding sleeve 360.

Figure 3B:
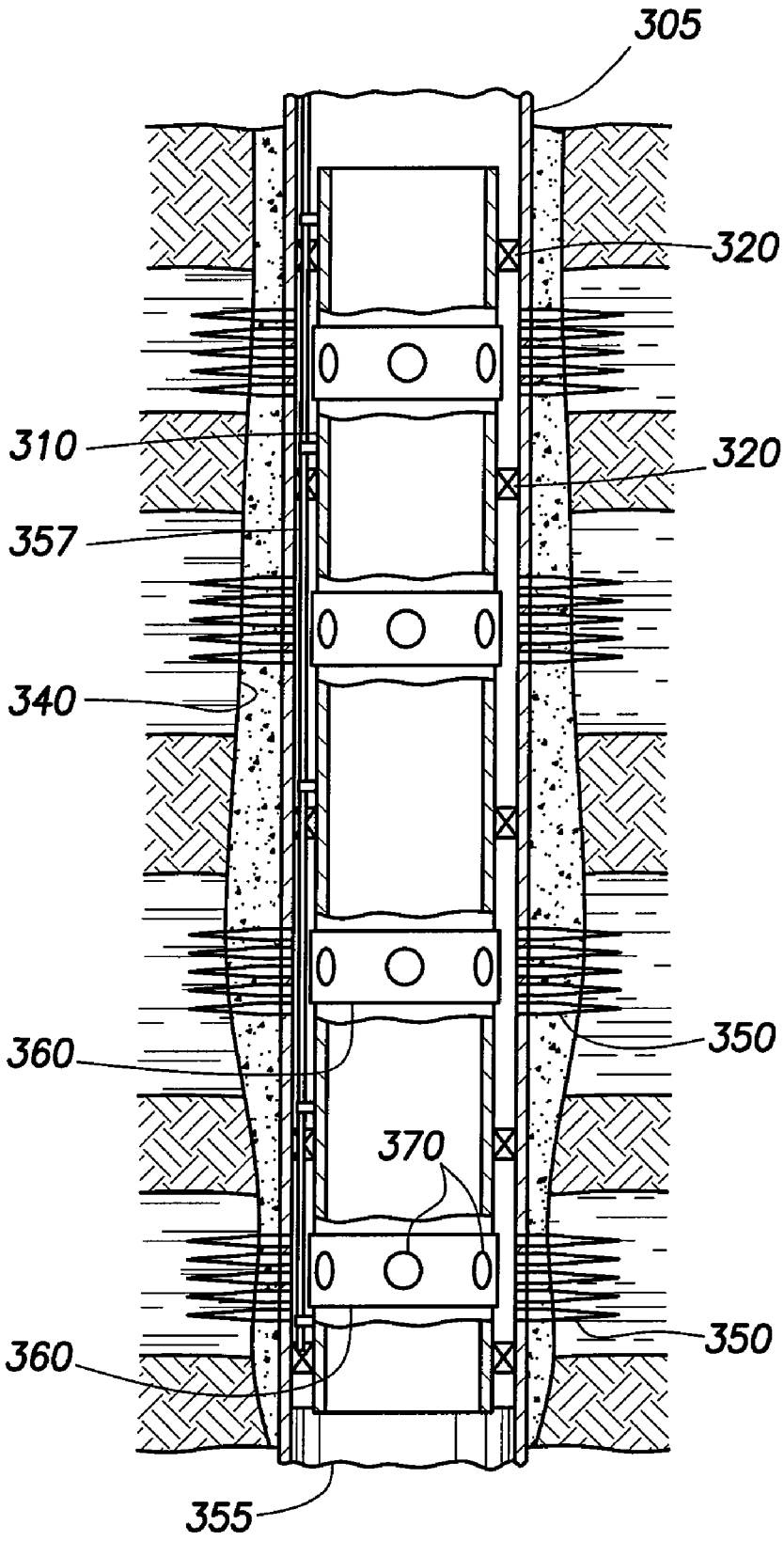
FIG. 3B illustrates a cross-sectional view of an isolation assembly in a well bore providing isolation of selected intervals of a well bore showing certain optional features in accordance with one embodiment of the present invention.

Certain embodiments may include umbilical line, wirelines, or tubes to the surface could be incorporated to provide for monitoring downhole sensors, electrically activated controls of subsurface equipment, for injecting chemicals, or any combination thereof. For example, in FIG. 3B, umbilical line 357 could be used, to actuate remote controlled sliding sleeves 360. Umbilical line 357 may run in between liner 310 and swellable packers 320, or umbilical line 357 may be run through swellable packers 320 as depicted in FIG. 3B. Umbilical line 357 may also be used as a chemical injection line to inject chemicals or fluids such as spotting treatments, nitrogen padding, $H_2S$ scavengers, corrosion inhibitors, or any combination thereof.

Although liner 310 and swellable packers 320 are shown as providing isolation along casing string 305, it is expressly recognized that liner 310 and swellable packers 320 may provide isolation to an openhole without a casing string or to a gravel pack as desired. Thus, casing string 305 is not a required feature in all embodiments of the present invention. In other words, the depiction of casing string 305 in the figures is merely illustrative and should in no way require the presence of casing string 305 in all embodiments of the present invention.

Figure 4:
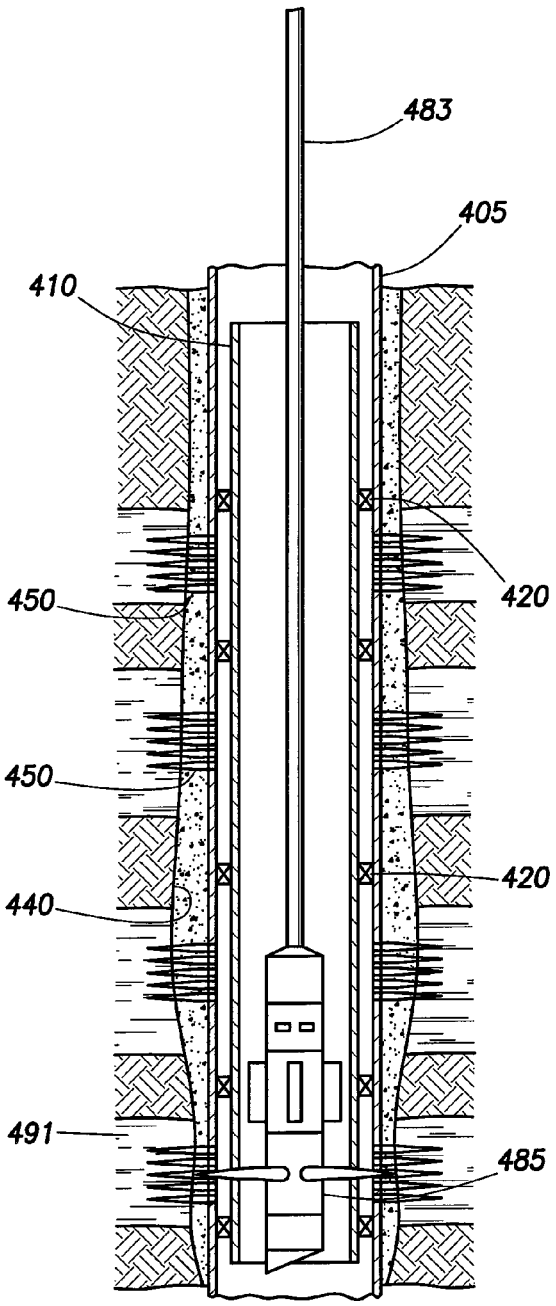
FIG. 4 illustrates a cross-sectional view of an isolation assembly in a well bore providing isolation of selected intervals of a well bore with hydra-jet perforating being performed on the lower most interval using coiled tubing.

As selected intervals are appropriately isolated and perforated using the isolation assembly, selected intervals may be treated as desired. FIG. 4 illustrates hydrajetting tool 485 introduced into liner 410 via coiled tubing 483. As depicted here, hydrajetting tool 485 may be used to perforate casing string 405 and initiate or enhance perforations into first well bore interval 491. Then, as desired, first interval 491 may be stimulated with hydrajetting tool 485 or by introducing a stimulation fluid treatment into liner 405. As would be recognized by a person skilled in the art with the benefit of this disclosure, the isolation and perforation of selected intervals may occur in a variety of sequences depending on the particular well profile, conditions, and treatments desired. In certain embodiments, several intervals may be perforated before isolation of one or more selected intervals. Several methods of perforating and fracturing individual layers exist. One method uses select-fire perforating on wireline with ball sealer diversion in between treatments. Another method uses conventional perforating with drillable bridge plugs set between treatments. Yet another method uses sliding windows that are open and closed with either wireline or coiled tubing between treatments. Another method uses retrievable bridge plugs and hydrajetting moving the bridge plug between intervals. Other methods use limited-entry perforating, straddle packer systems to isolate conventionally perforated intervals, and packers on tubing with conventional perforating.

Examples of suitable treatments that may be apply to each selected interval include, but are not limited to, stimulation treatments (e.g. a fracturing treatment or an acid stimulation treatment), conformance treatments, sand control treatments, consolidating treatments, sealing treatments, or any combination thereof. Additionally, whereas these treating steps are often performed as to previously treated intervals, it is expressly recognized that previously bypassed intervals may be treated in a similar manner.

Figure 5A:
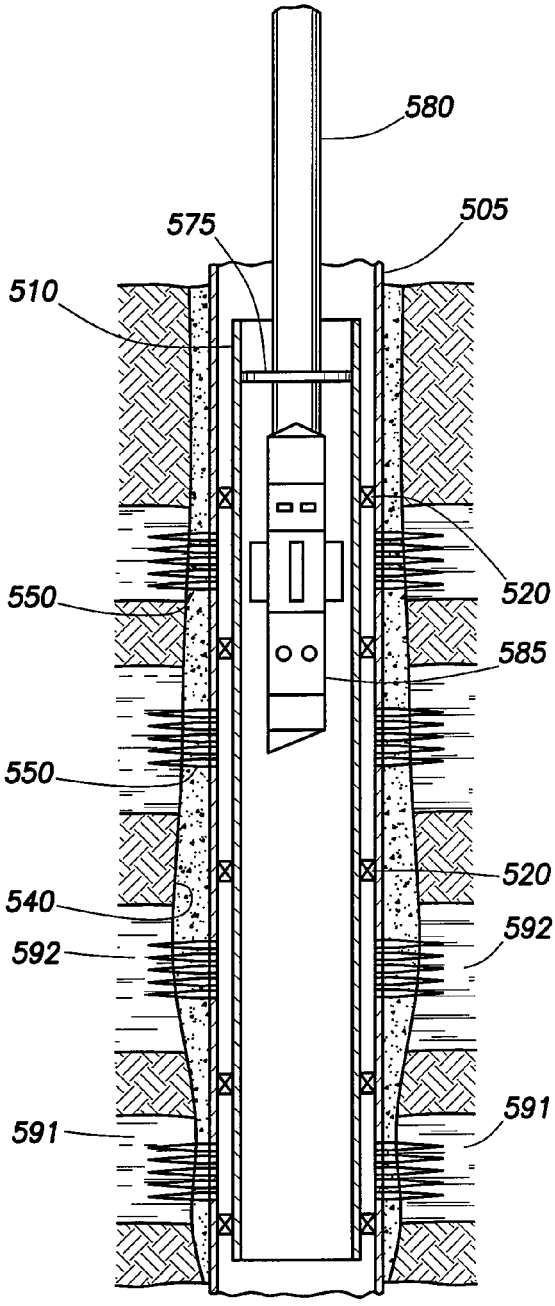
FIG. 5A illustrates placement of an isolation assembly into a well bore via a jointed pipe attached to a hydrajetting tool so as to allow a one trip placement and treatment of a multiple interval well bore in accordance with one embodiment of the present invention.

FIG. 5A illustrates placement of an isolation assembly into a well bore via a jointed pipe attached to a hydrajetting tool so as to allow a one trip placement and treatment of a multiple interval well bore in accordance with one embodiment of the present invention. One of the advantages of this implementation of the present invention includes the ability to set isolation assembly and perform perforation and treatment operations in a single trip in well bore 540. Jointed pipe 580 may be used to introduce liner 510 into well bore 540. More particularly, jointed pipe 580 is attached to liner 510 via attachment 575. After liner 510 is introduced into well bore 540, swellable packers may be allowed to swell to create a fluid tight seal against casing string 505 so as to isolate or reisolate the well bore intervals of well bore 540. Once liner 510 is set in place, attachment 575 may be sheared or otherwise disconnected from liner 510.

Figure 5B:
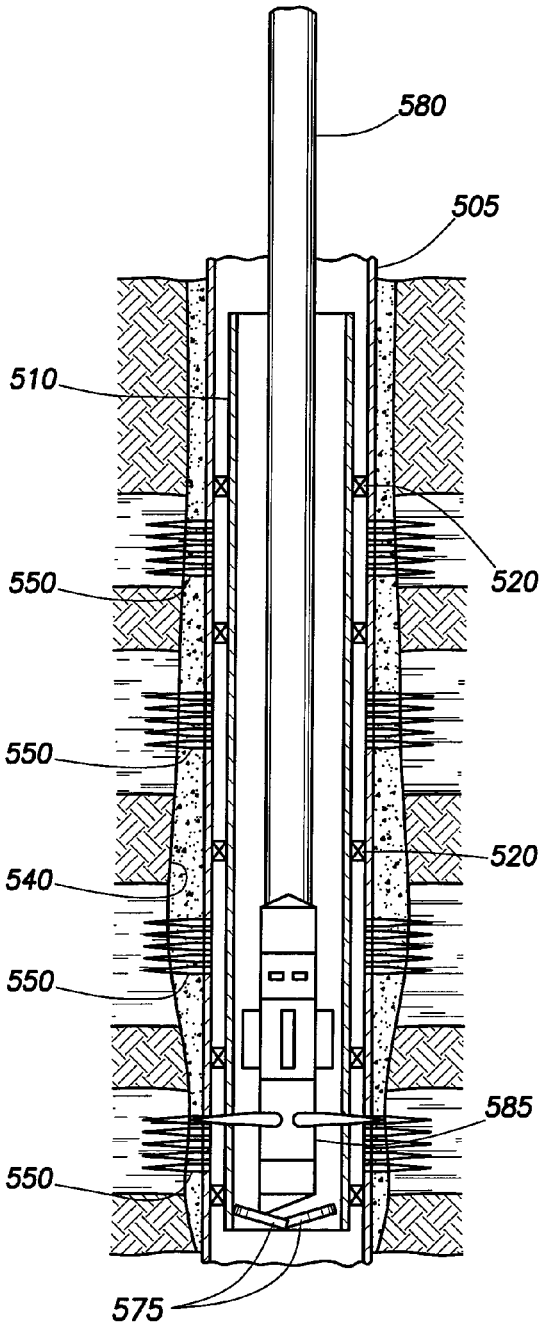
FIG. 5B illustrates a hydrajetting tool lowered to a well bore interval to be treated, the hydrajetting tool perforating the liner and initiating or enhancing perforations into a selected interval of a well bore.
Figure 5C:
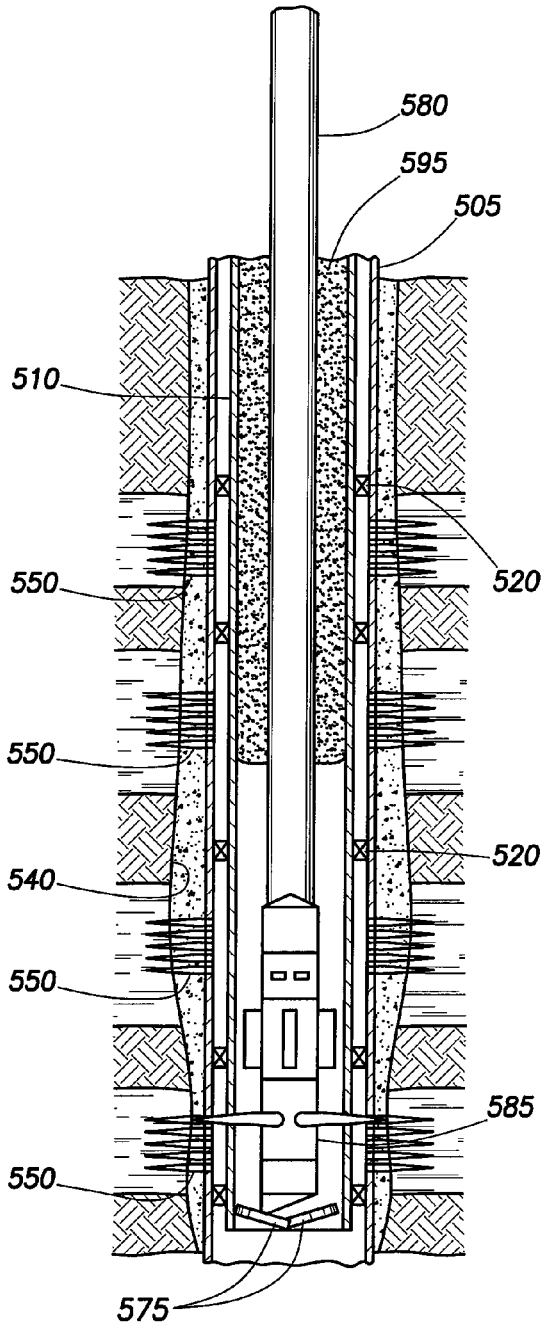
FIG. 5C illustrates the introduction of a fluid treatment to treat a selected interval of a multiple interval well bore.
Figure 5D:
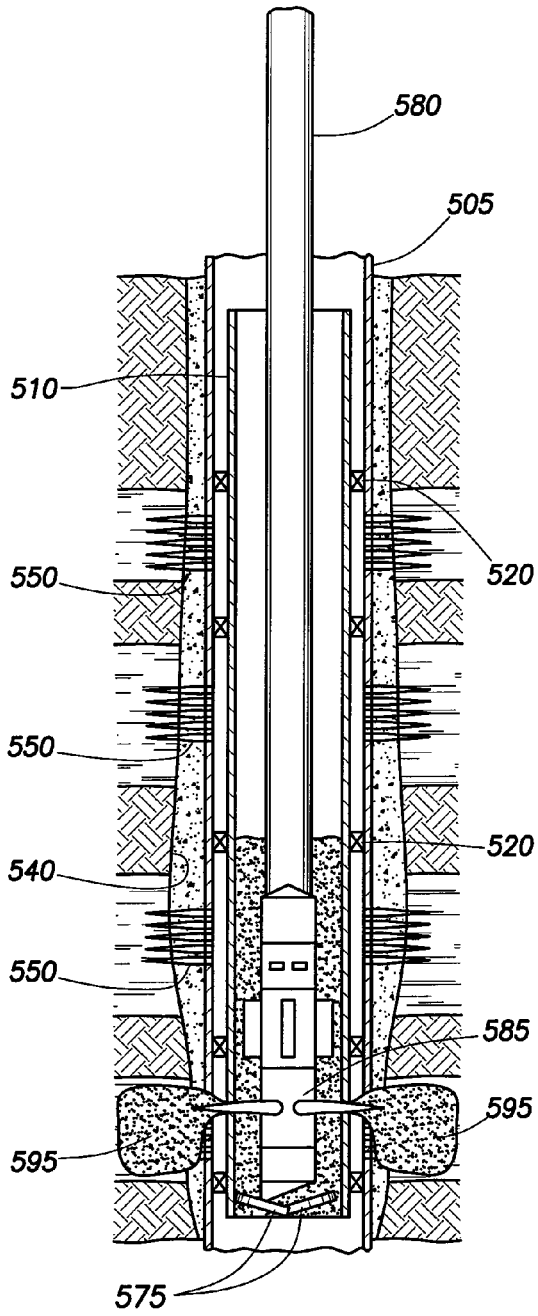
FIG. 5D illustrations treatment of a selected interval of a multiple interval well bore with a fluid treatment.
Figure 5E:
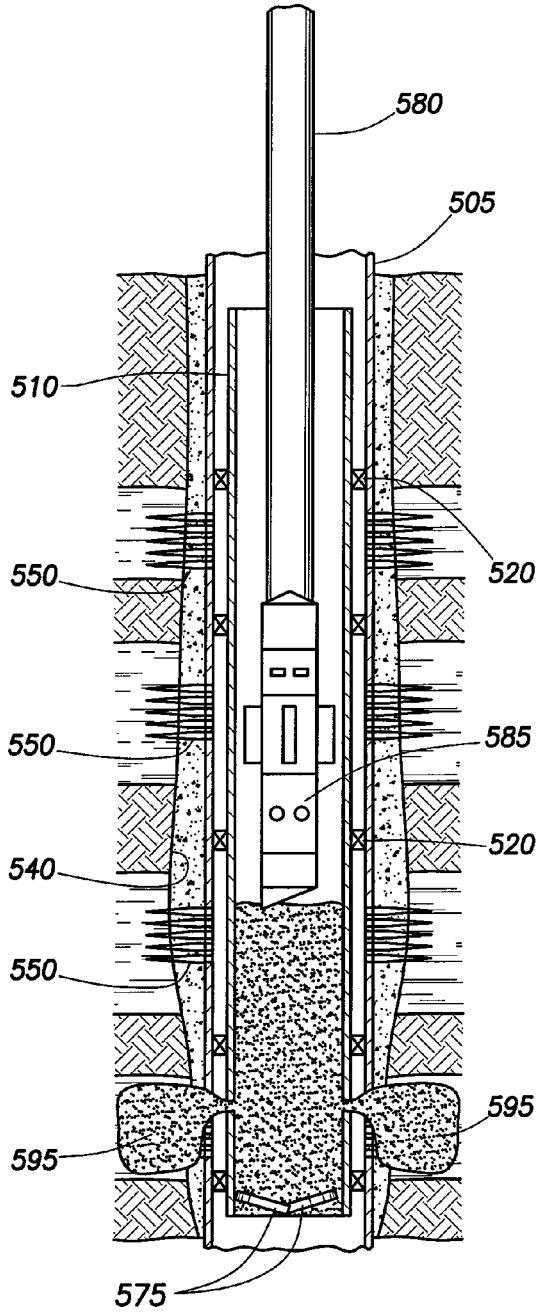
FIG. 5E illustrates hydrajetting tool retracted from first well bore interval 591 to above a diversion proppant plug of fracturing treatment.
Figure 5F:
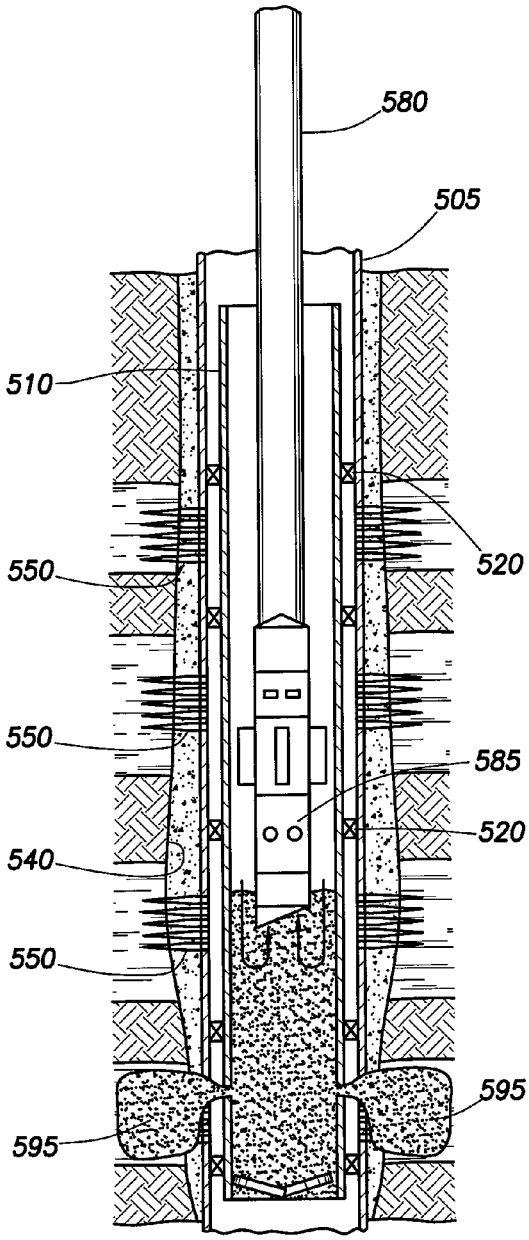
FIG. 5F illustrates excess proppant being removed by reversing out a proppant diversion plug to allow treatment of another selected well bore interval of interest.

Once attachment 575 is sheared or otherwise disconnected, hydrajetting tool 585 may be lowered to a well bore interval to be treated, in this case, first well bore interval 591 as illustrated in FIG. 5B. As depicted here, hydrajetting tool 585 may be used to perforate casing string 505 and initiate or enhance perforations into first well bore interval 591. Then, as illustrated in FIG. 5C, a fluid treatment (in this case, fracturing treatment 595) may be introduced into liner 510 to treat first well bore interval 591. In FIG. 5D, fracturing treatment 595 is shown being applied to first well bore interval 591. At some point, after perforating first well bore interval 591 with hydrajetting tool 585, hydrajetting tool 585 may be retracted to a point above the anticipated top of the diversion proppant plug of the fracturing treatment. In FIG. 5E, hydrajetting tool 585 is retracted from first well bore interval 591 above the diversion proppant plug of fracturing treatment 595. In FIG. 5F, excess proppant is removed by reversing out the proppant diversion plug to allow treatment of the next well bore interval of interest.

Figure 5G:
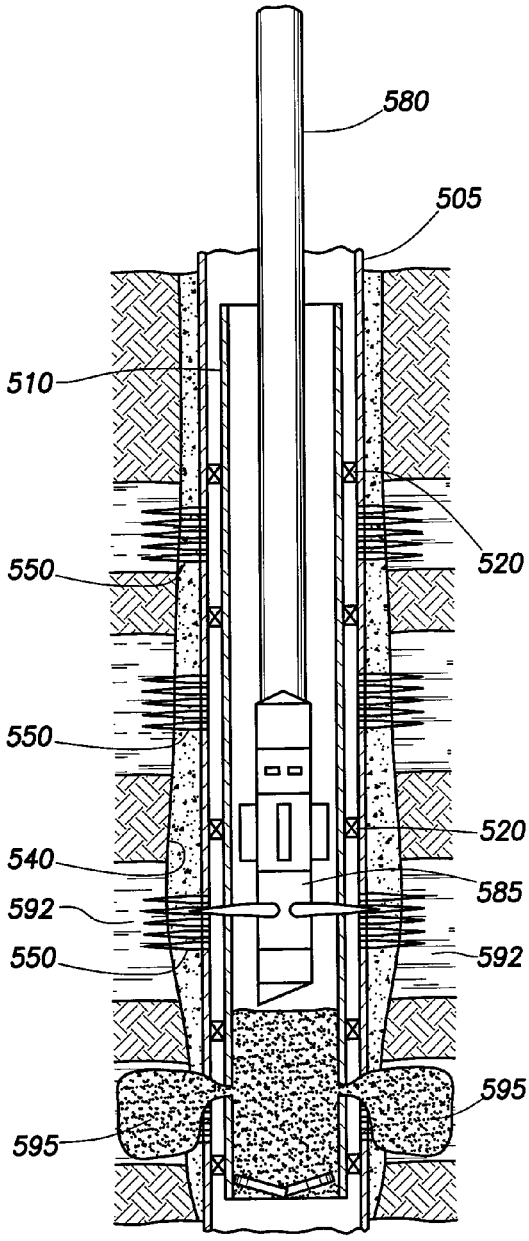
FIG. 5G illustrates a hydrajetting tool perforating the liner and initiating or enhancing perforations into a subsequent selected interval so as to allow treatment thereof.

After removal of the excess proppant, hydrajetting tool 585 may be used to perforate casing string 505 and initiate or enhance perforations into second well bore interval 592 as illustrated in FIG. 5G. Fluid treatments may then be applied to second well bore interval 592. In a like manner, other well bore intervals of interest may be perforated and treated or retreated as desired. Additionally, it is expressly recognized that bypassed intervals between two producing intervals may likewise be perforated and treated as well.

As a final step in the process the tubing may be lowered while reverse circulating to remove the proppant plug diversion and allow production from the newly perforated and stimulated intervals.

Traditionally fracturing relies on sophisticated and complex bottomhole assemblies. Associated with this traditional method of fracturing are some high risk processes in order to achieve multi-interval fracturing. One major risk factor associated with traditional fracturing is early screen-outs. By implementing the sleeves and isolation assembly depicted in FIGS. 6-10, some of these risks may be reduced or eliminated as a single trip into the well provides for multi-interval fracturing operations and a screened completion after all intervals have been stimulated.

Figure 6B:
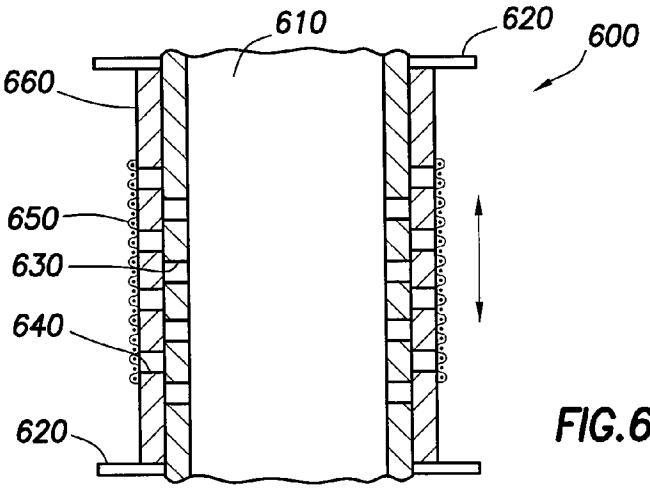
FIG. 6B illustrates a cross-sectional view of a screen-wrapped sleeve in a well bore in a closed position.
Figure 6D:
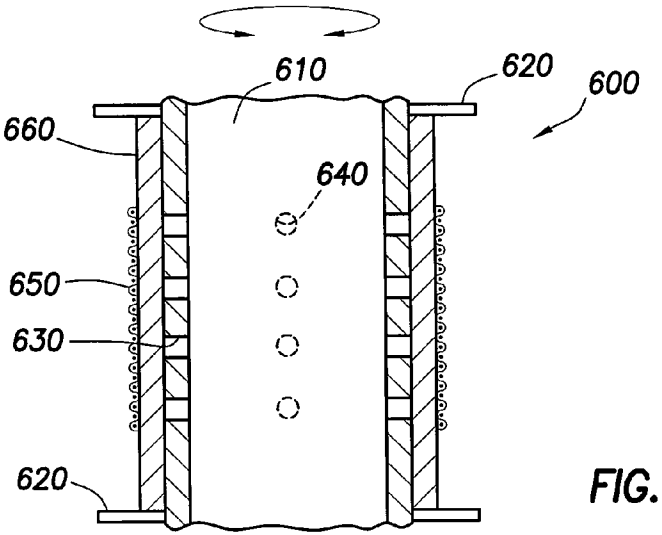
FIG. 6D illustrates a cross-sectional view of a screen-wrapped sleeve in a well bore in a closed position.
Figure 6A:
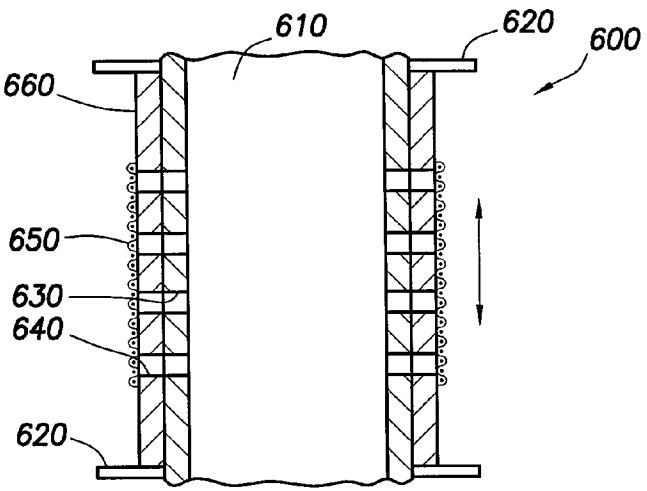
FIG. 6A illustrates a cross-sectional view of a screen-wrapped sleeve in a well bore in an open to screen position.

FIGS. 6A-6D illustrate, generally, cross-sectional views of a screen-wrapped sleeve in a well bore 600. In FIG. 6A, screen-wrapped sleeve 660 is a sleeve with a screen 650 or other acceptable fines mitigation device covering ports 640. The ports 640 allow for fluid, such as production fluid, to flow through screens 650 of the screen-wrapped sleeves 660. In certain embodiments, screens 650 may be disposed about the outside of the screen-wrapped sleeve 660 so as to provide a screened covering all ports 640. In other example embodiments, screens 650 may be placed within the openings of the ports 640 or in any other manner suitable for preventing proppant flowback through the screen-wrapped sleeves 660. The screens 650 act to prevent proppant flowback or sand production. Providing prevention of proppant flowback issues is of special importance in the North Sea, Western Africa, and the Gulf Coast. For instance, in the North Sea, conductivity endurance materials are black-listed. Providing a solution to proppant flowback issues leads to better fractured completions and addresses environmental concerns.

To prevent the walls of the well bore from damaging the screens 650, one or more centralizers 620 may be disposed about the screen-wrapped sleeve 660 or liner 610. As shown in FIG. 6A, centralizers 620 may be positioned above and below the screen-wrapped sleeve 660. In certain embodiments, one or more centralizers 620 may be positioned only above, only below, above and below, or any location along the liner 610 or the screen-wrapped sleeve 660.

Screen-wrapped sleeve 660 is disposed around a liner 610 as part of an isolation assembly discussed below with respect to FIGS. 10A and 10B. In certain embodiments, liner 610 may have preformed ports 630. In other embodiments, ports 630 may be formed after the isolation assembly has been inserted into the well bore.

As indicated in FIG. 6A, screen-wrapped sleeve 660 may be displaced longitudinally a selected spacing along the liner 610 to an open to screen position so as to align ports 630 and 640 with each other. In certain embodiments, adjusting the screen-wrapped sleeve 660 to an open to screen position allows fluids to flow from the well bore through the ports 640 of the screen-wrapped sleeve 660 and through the ports 630 and into the liner 610. In one embodiment, production fluids are received into the liner 610 from ports 640 and 630 from a selected interval. Multiple selected intervals may receive fluids at the same time. The multiple selected intervals may be contiguous, non-contiguous or any combination thereof.

Figure 6C:
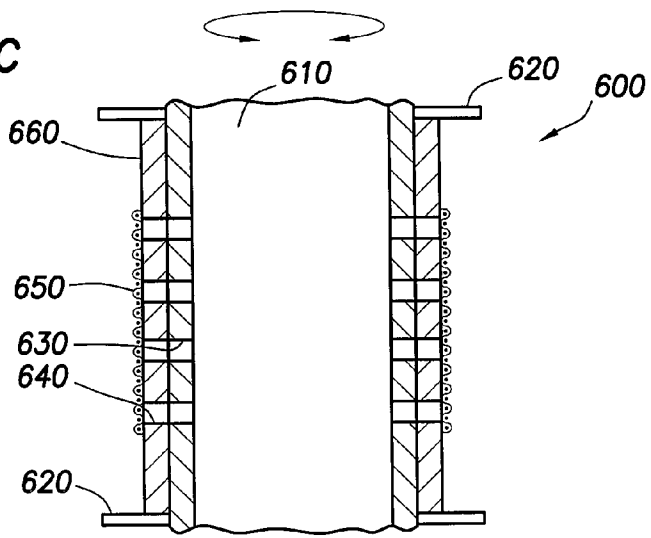
FIG. 6C illustrates a cross-sectional view of a screen-wrapped sleeve in a well bore in an open to screen position.

FIG. 6B illustrates the screen-wrapped sleeve 660 displaced longitudinally along the liner 610 to a closed position (ports 630 and 640 are not aligned with each other) preventing any fluid from the well bore to flow through ports 640 and 630 and into the liner 610. In certain embodiments and as shown in FIG. 6C, the screen-wrapped sleeve 660 is displaced to an open to screen position by rotating the screen-wrapped sleeve 660 in a clockwise or counter-clockwise manner so as to allow fluid to flow from the well bore through ports 640 and 630 and into liner 610. FIG. 6D illustrates the screen-wrapped sleeve 660 rotated in a clockwise or counter-clockwise manner to a closed position preventing any fluid from the well bore to flow through ports 640 and 630 and into the liner 610. In one example embodiment, screen-wrapped sleeve 660 may be displaced by actuating a shifting tool to adjust positioning of the screen-wrapped sleeve 660.

Figure 7A:
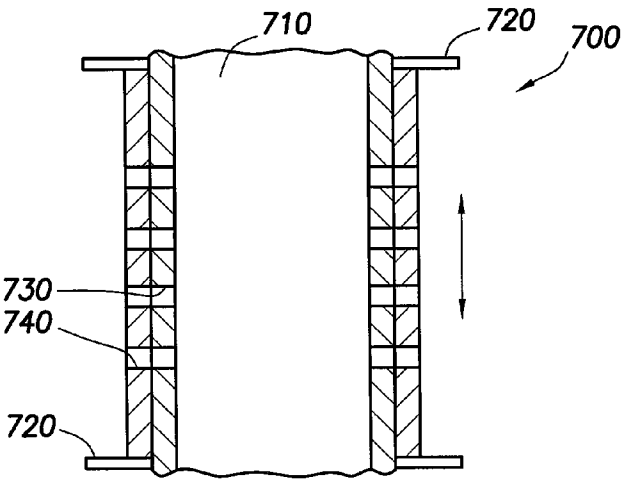
FIG. 7A illustrates a cross-sectional view of a sleeve in a well bore in an open position.

FIGS. 7A-7D illustrate, generally, cross-sectional views of a sleeve in a well bore 700. In FIG. 7A, sleeve 770 is a sleeve with ports 740. A screen is not necessary for sleeve 770. Unlike the screen-wrapped sleeves 670 there is no need to prevent proppant flowback as sleeve 770 allows for the flowing of fluid out of the liner and into the well bore at the selected interval. Sleeve 770 is disposed around a liner 710 as part of an isolation assembly discussed below with respect to FIGS. 10A and 10B. In certain embodiments, liner 710 may have preformed ports 730. In other embodiments, ports 730 may be formed after the liner 710 has been inserted into the well bore.

To prevent the walls of the well bore from damaging the screens of screen-wrapped sleeves (not shown) such as screen-wrapped sleeves 660 of FIG. 6, one or more centralizers 720 may be disposed about the sleeve 770 or liner 710. As shown in FIG. 7A, centralizers 720 are positioned above and below the sleeve 770. In certain embodiments, one or more centralizers 720 may be positioned only above, only below, above and below, or any location along the liner 710 or the sleeve 770.

As indicated in FIG. 7A, sleeve 770 may be displaced longitudinally a selected spacing along the liner 710 to an open position so as to align ports 730 and 740 with each other. In certain embodiments, sleeve 770 is adjusted to an open position (ports 730 and 740 are aligned with each other) allowing fluids to flow through the liner 710 and through ports 730 and 740 into the well bore. For instance, fracturing fluids may be flowed through ports 730 and 740 so as to stimulate a selected interval. Multiple selected intervals may be stimulated at the same time. The multiple selected intervals may be contiguous, non-contiguous or any combination thereof.

Figure 7B:
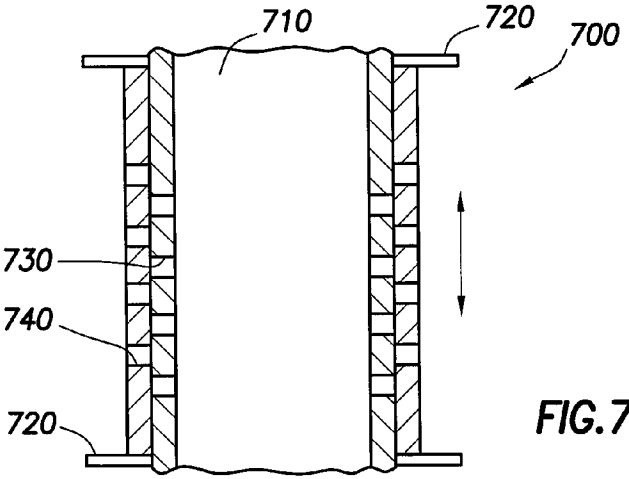
FIG. 7B illustrates a cross-sectional view of a sleeve in a well bore in a closed position.

FIG. 7B illustrates the sleeve 770 displaced longitudinally along the liner 710 to a closed position (ports 730 and 740 are not aligned with each other). When sleeve 770 is adjusted to the closed position, fluids are prevented from flowing through the liner 710 and through ports 730 and 750 and into the well bore. In the closed position, sleeve 770 reestablishes zonal isolation of the selected interval.

Figure 7C:
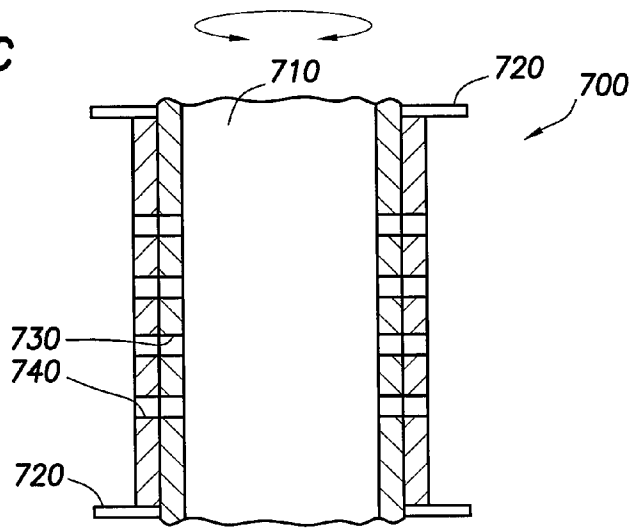
FIG. 7C illustrates a cross-sectional view of a sleeve in a well bore in an open position.
Figure 7D:
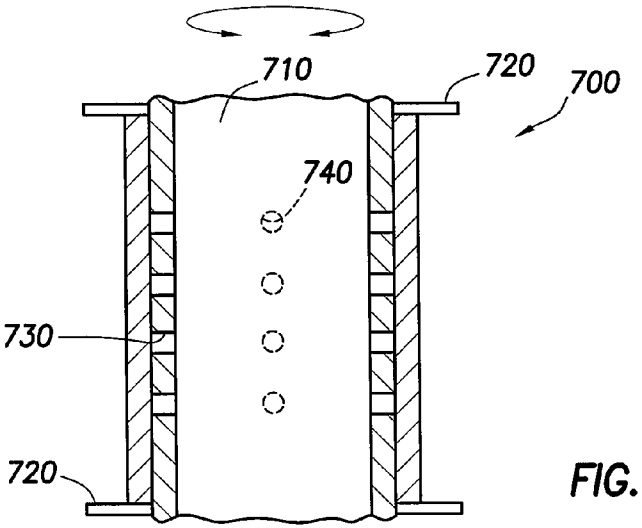
FIG. 7D illustrates a cross-sectional view of a sleeve in a well bore in a closed position.

In certain embodiments and as shown in FIG. 7C, the sleeve 770 is displaced about the liner 710 to an open position by rotating the sleeve 770 in a clockwise or counter-clockwise manner so as to allow fluid to flow from the liner 710 through ports 730 and 740 and into the well bore. FIG. 7D illustrates the sleeve 770 rotated in a clockwise or counter-clockwise manner to a closed position preventing any fluid from the liner 710 to flow through ports 730 and 740 and into the well bore. In one example embodiment, sleeve 770 may be displaced by actuating a shifting tool to adjust positioning of the sleeve 770.

Figure 8C:
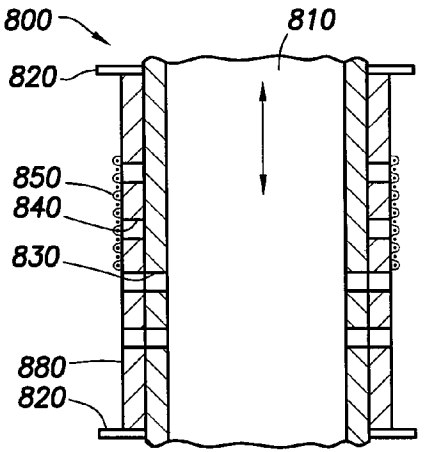
FIG. 8C illustrates a cross-sectional view of a sleeve in a well bore in an open position.
Figure 8B:
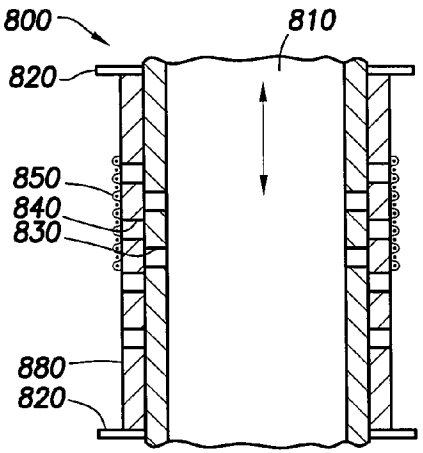
FIG. 8B illustrates a cross-sectional view of a sleeve in a well bore in a closed position.
Figure 8A:
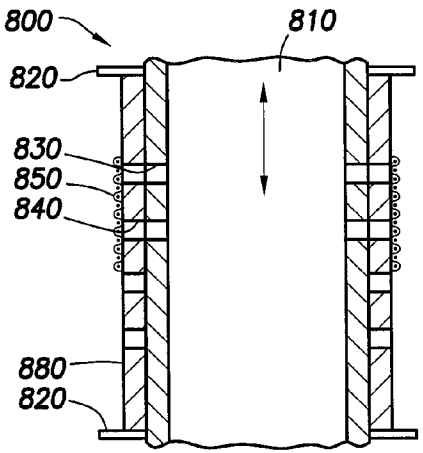
FIG. 8A illustrates a cross-sectional view of a sleeve in a well bore in an open to screen position.

In certain embodiments the functionality of screen-wrapped sleeve 660 and the sleeve 770 may be combined as illustrated in FIGS. 8A-8F. FIGS. 8A-8F depict, generally, cross-sectional views of a sleeve in a well bore 800 having a screened section, a non-screened section, and a non-screened section with openings. Such a multi-functional sleeve is depicted in FIG. 8A as sleeve 880. Sleeve 880 may have ports 840. Some of the ports 840 may be covered with a screen 850. The screened portion of sleeve 880 operates in a similar manner to the screen-wrapped sleeve 660 of FIG. 6. The non-screened portion of sleeve 880 operates in a similar manner to sleeve 770. Sleeve 880 is disposed around a liner 810 as part of an isolation assembly discussed with respect to FIGS. 10A and 10B.

In certain embodiments, liner 810 may have preformed ports 830. In other embodiments, ports 830 may be formed after the liner 810 has been inserted into the well bore. To prevent the walls of the well bore from damaging the screens 850, one or more centralizers 820 may be disposed about the sleeve 880 or liner 810. As shown in FIG. 8A, centralizers 820 are positioned above and below the sleeve 880. In certain embodiments, one or more centralizers 820 may be positioned only above, only below, above and below, or any location along the liner 810 or the sleeve 880. As indicated in FIG. 8A, sleeve 880 may be displaced longitudinally a selected spacing along the liner 810 to an open to screen position so as to align ports 830 and 840 with each other. In certain embodiments, sleeve 880 is adjusted to an open to screen position which allows fluids to flow from the well bore through the ports 840 of the sleeve 880 and through the ports 830 of the liner 810. FIG. 8B illustrates the sleeve 880 displaced longitudinally along the liner 810 to a closed position preventing any fluid from the well bore to flow through ports 840 and 830 and into the liner 610 and also prevents fluids from flowing through the liner 810 and out ports 830 and 840. FIG. 8C illustrates the sleeve 880 displaced longitudinally along the liner 810 to an open position to allow fluid to flow from the liner 810 and through ports 830 and 840 and into the well bore.

Figure 8F:
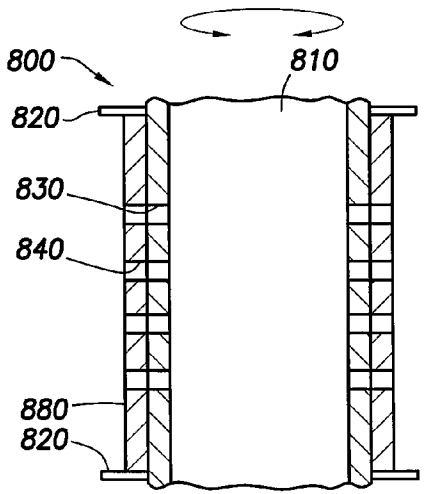
FIG. 8F illustrates a cross-sectional view of a sleeve in a well bore in an open position.
Figure 8E:
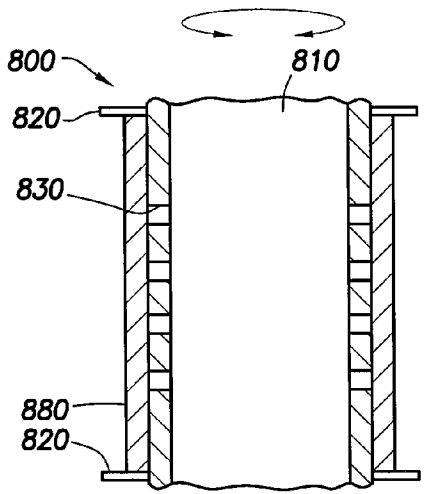
FIG. 8E illustrates a cross-sectional view of a sleeve in a well bore in a closed position.
Figure 8D:
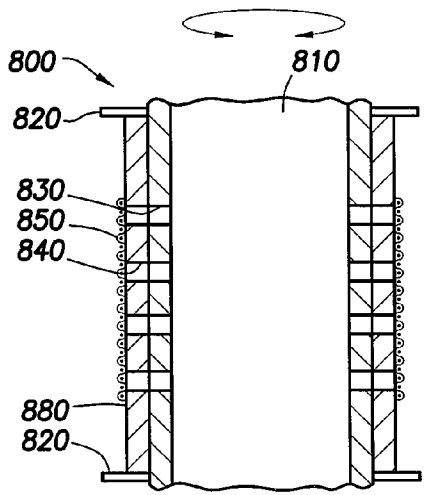
FIG. 8D illustrates a cross-sectional view of a sleeve in a well bore in an open to sleeve position.

In certain embodiments and as shown in FIG. 8D, the sleeve 880 is displaced about the liner 810 to an open to screen position by rotating the sleeve 880 in a clockwise or counter-clockwise manner so as to allow fluid to flow from the well bore and through ports 840 and 830 and into liner 810. FIG. 8E illustrates the sleeve 880 rotated in a clockwise or counter-clockwise manner to a closed position preventing any fluid from the well bore to flow through ports 840 and 830 and into the liner 810 and also prevents fluids from flowing through the liner 810 and out ports 830 and 840. FIG. 8F illustrates the sleeve 880 actuated to displace the sleeve 880 about the liner 810 to an open position so as to allow fluid to flow from the liner 810 through ports 830 and 840 and into the well bore. In one example embodiment, sleeve 880 may be displaced by actuating a shifting tool to adjust positioning of the sleeve 880.

Figure 9B:
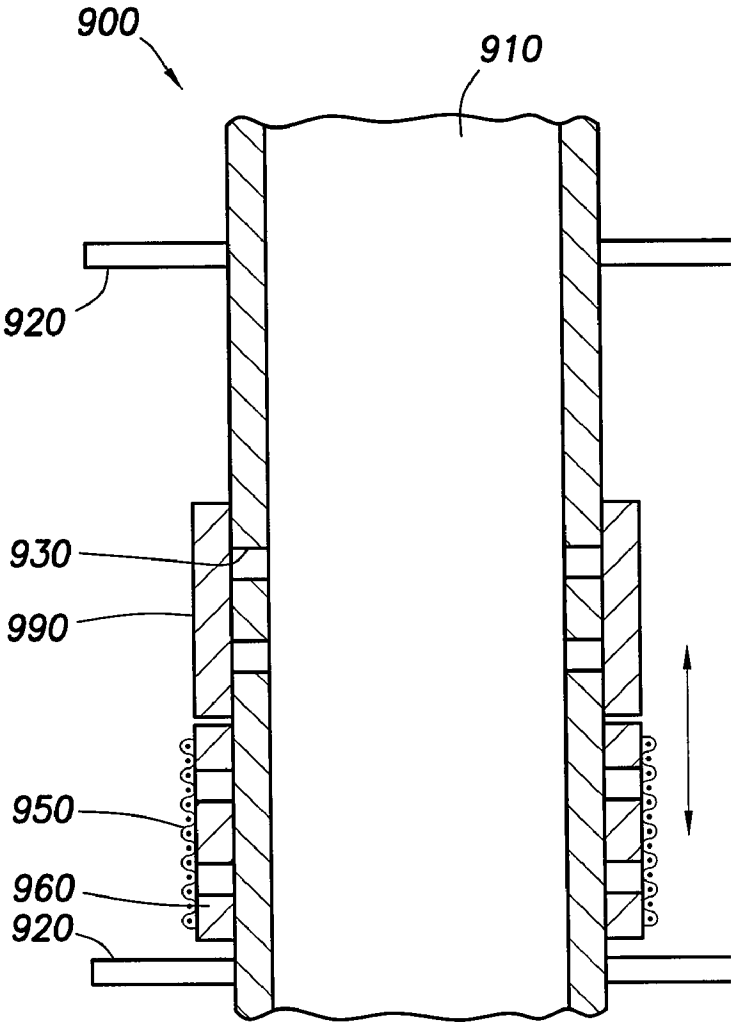
FIG. 9B illustrates a cross-sectional view of a sleeve in a well bore in a closed position.
Figure 9A:
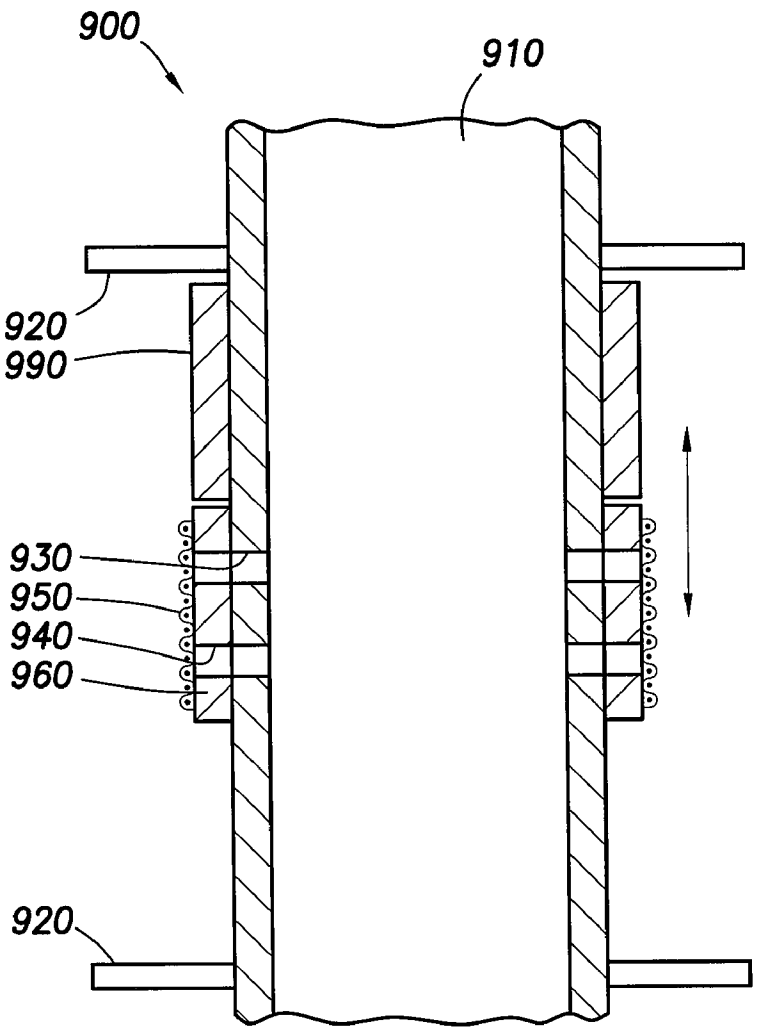
FIG. 9A illustrates a cross-sectional view of a sleeve in a well bore in an open position.

FIGS. 9A-9B illustrate, generally, cross-sectional views of a sleeve in a well bore 900. In certain embodiments, one or more sleeves 970 and one or more sleeves 960 may be disposed about a liner 910. In FIG. 9A, screen-wrapped sleeve 960 is a sleeve with a screen 950 or other acceptable fines mitigation device covering ports 940 of the sleeve 960. In FIG. 9A, sleeve 990 is a sleeve without any ports. Sleeve 960 and sleeve 990 are disposed around a liner 910 as part of an isolation assembly discussed with respect to FIGS. 10A and 10B. In certain embodiments, liner 910 may have preformed ports 930. In other embodiments, ports 930 may be formed after the liner 910 has been inserted into the well bore. To prevent the walls of the well bore from damaging the screens 950, one or more centralizers 920 may be disposed about the sleeve 960 or liner 910. As shown in FIG. 9A, centralizers 920 are positioned above and below the sleeve 960. In certain embodiments, one or more centralizers 920 may be positioned only above, only below, above and below, or any location along the liner 910 or the sleeve 960. As depicted in FIG. 9A, screen-wrapped sleeve 960 and sleeve 990 may be displaced longitudinally a selected spacing along the liner 910 to an open to screen position so as to align ports 930 of the liner 910 with ports 940 of the screen-wrapped sleeve 960. In certain embodiments, an open to screen position allows fluids to flow from the well bore through the ports 940 of the sleeve 960 and through the ports 930 of the liner 910. FIG. 9B illustrates a solid sleeve 990, with no ports, actuated to displace longitudinally along the liner 910 to prevent any fluid from the well bore to flow through 930 and into the liner 910 and also to prevent fluids from flowing through the liner 910 and out ports 930.

Figure 10B:
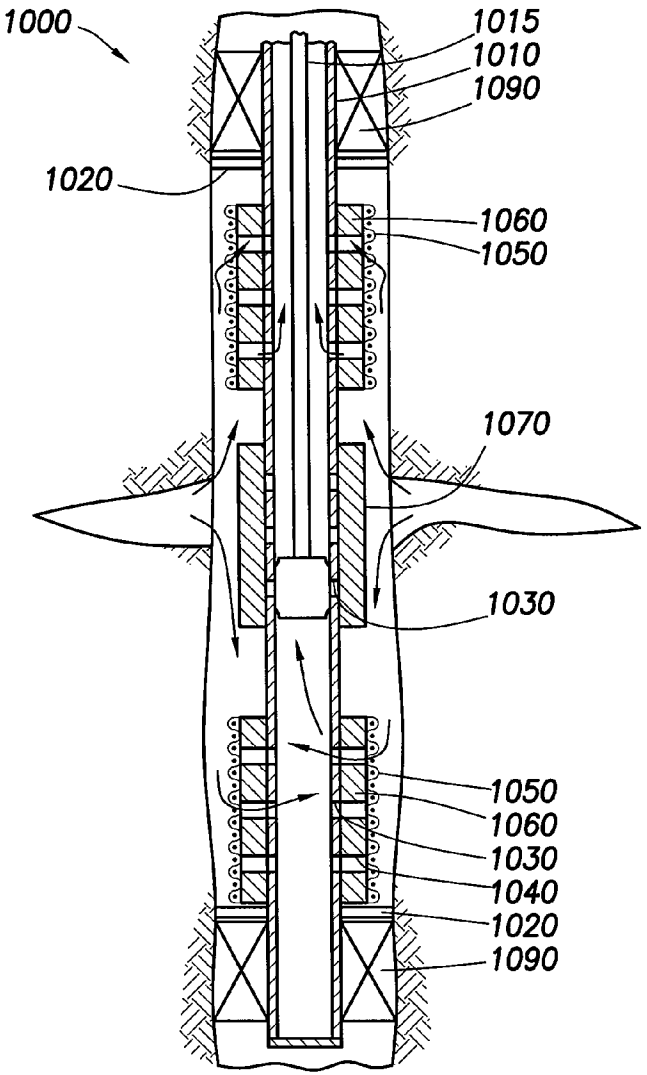
FIG. 10B illustrates a cross-sectional view of an isolation assembly in a well bore.
Figure 10A:
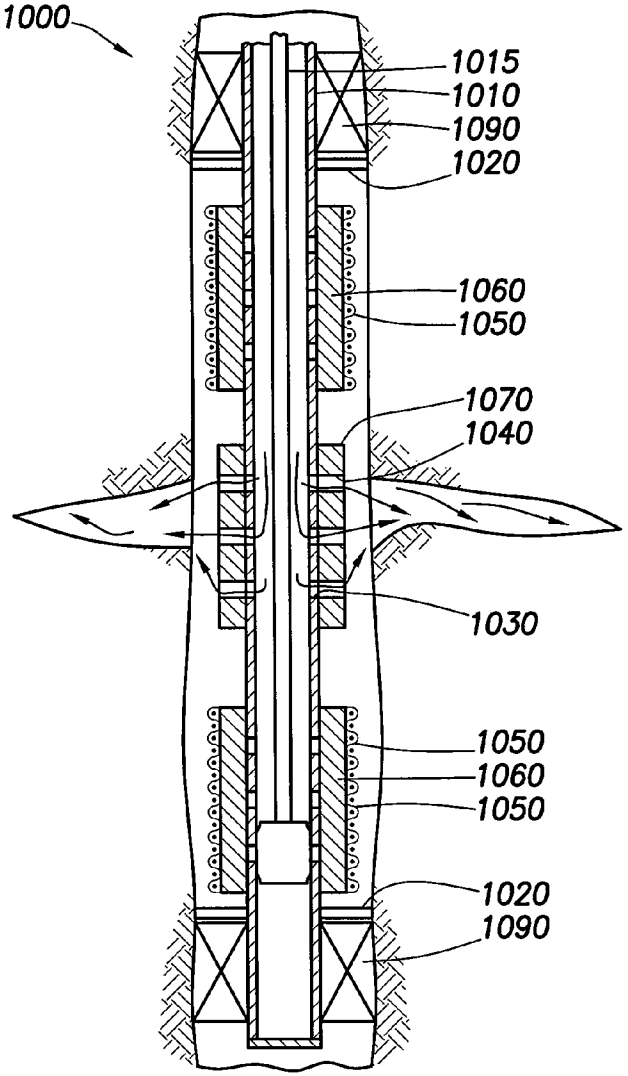
FIG. 10A illustrates a cross-sectional view of an isolation assembly in a well bore.

FIGS. 10A and 10B illustrate, generally, cross-sectional views of an isolation assembly 1000 in a well bore so as to allow a one trip placement and treatment of a multiple interval well bore in accordance with one embodiment of the present invention. One of the advantages of this implementation of the present invention includes the ability to introduce isolation assembly 1000 downhole and perform treatment and production operations in a single trip in the well bore. One or more sleeves 1070 and one or more screen-wrapped sleeves 1060 are disposed around liner 1010. Sleeves 1070 have one or more ports 1040 (shown in FIG. 10B). Sleeves 1070 may function similarly to sleeves 770. Screen-wrapped sleeves 1060 have one or more ports 1040 covered by a screen 1050. Screen-wrapped sleeves 1060 may function similarly to screen-wrapped sleeves 660. In one embodiment, sleeves 1070 and screen-wrapped sleeves 1060 may be replaced with a sleeve having the functionality of both screen-wrapped sleeves 1060 and sleeves 1070 such as sleeve 880 depicted in FIG. 8.

One or more swellable packers 1090 are also disposed around liner 1010. Also, to prevent the walls of the well bore from damaging the screens 1050, one or more centralizers 1020 may be disposed about the sleeve 1060 or liner 1010. As shown in FIGS. 10A and 10B, centralizers 1020 are positioned above and below the sleeves 1060. In certain embodiments, one or more centralizers 1020 may be positioned only above, only below, above and below, or any location along the liner 1010 or the sleeve 1080.

The method of selecting, stimulating, and producing hydrocarbons from an interval or zone using an isolation assembly will now be described with reference to FIG. 10A and FIG. 10B. First, the isolation assembly 1000 is introduced into the well bore. Second, the swellable packers 1090 may be allowed to swell to create a fluid tight seal so as to isolate or reisolate selected intervals of the well bore. The swellable packers 1090 may be formed of a variety of materials such as those stated for swellable packer 120. Any method generally known to one of ordinary skill in the art may be used to swell the swellable packers 1090 as well as those discussed with respect to FIG. 2. For illustration purposes only, FIGS. 10A and 10B depict a selected interval between swellable packers 1090 with two screen-wrapped sleeves 1060 and one sleeve 1070. In other embodiments, a selected interval isolated by swellable packers 1090 may include any number of screen-wrapped sleeves 1060 and any number of sleeves 1070. Other example embodiments may also include multiple selected intervals isolated by multiple swellable packers 1090. Another example embodiment may include a sleeve with the functional characteristics of both 1060 and 1070 as depicted in FIGS. 8A-8D.

Next, a shifting tool 1015 may be introduced into liner 1010. As depicted here, the shifting tool 1015 may be actuated to displace the sleeves 1070 and screen-wrapped sleeves 1060 about the liner 1010. Displacement or adjustment of position of sleeves 1070 and screen-wrapped sleeves 1060 may occur longitudinally along the liner 1010 or rotationally about the liner 1010 as described in FIGS. 5-9. The shifting tool 1015 may be deployed within tubing, coiled tubing, wireline, drill-pipe or on any other acceptable mechanism.

Once a selected interval has been isolated, the shifting tool 1015 actuates the sleeve 1070 to adjust positioning of the sleeve 1070 to an open position. Screen-wrapped sleeves 1060 are in a closed position to prevent any fluid from flowing back into the liner 1010. The well bore is treated with fluid that flows down the liner 1010, through ports 1030 and 1040 and out into the well bore. In one example embodiment, the selected intervals are treated with fracturing fluid so as to stimulate the well bore.

The swellable packers 1090 prevent any fluid from flowing outside the selected interval so as to form zonal isolation of the selected interval. After treatment, the sleeve 1070 is actuated by the shifting tool 1015 to a closed position. Fluid treatments may then be applied to other selected intervals in like manner. In another embodiment, multiple selected intervals isolated by multiple swellable packers 1090 may be treated simultaneously by actuating multiple sleeves 1070 in the multiple selected intervals to an open position and then flowing the treatment fluid. Multiple selected intervals may be contiguous, non-contiguous or a combination thereof.

Once the selected intervals have been treated, sleeves 1070 may be actuated to a closed position in order to reestablish zonal isolation of the selected interval and to allow for further operations of the well bore. For instance, the shifting tool 1015 may actuate screen-wrapped sleeves 1060 to an open or open to screen position in a selected interval as depicted in FIG. 10B. Fluid flows from the well bore through ports 1040 and 1030 and into the liner 1010. In one example embodiment the fluid is production fluid. In another embodiment, multiple selected intervals isolated by multiple swellable packers 1090 with one or more screen-wrapped sleeves 1060 are actuated to an open position so as to allow fluid to flow through ports 1040 and 1030 and into liner 1010 from the multiple selected intervals. Again, multiple selected intervals need not be contiguous.

Screen-wrapped sleeves 1060 may be actuated to a closed position to allow for further operations of the well bore. In one example embodiment, refracturing of the well bore may be initiated by actuating the sleeves 1070 to an open position so as to allow treatment of the well bore. In another embodiment, new selected intervals may be chosen for stimulation and receipt of production fluids.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A method for multi-interval fracturing treatment comprising the steps of:

(a) introducing a multi-interval fracture treatment isolation assembly to a wellbore, the multi-interval fracture treatment isolation assembly comprising a liner, a first fluid communication port, a first sleeve movable relative to the first fluid communication port, a second fluid communication port, a second sleeve movable relative to the second fluid communication port, at least one fines mitigation device, and at least one annular isolation device coupled to the liner;

(b) activating the annular isolation device so as to provide zonal isolation to a plurality of selected intervals;

(c) delivering a fracturing treatment fluid to a first selected interval through the first fluid communication port;

(d) actuating a shifting tool so as to move the first sleeve into a position whereby fluid flow through the first fluid communication port is terminated;

(e) delivering a fracturing treatment fluid to a second selected interval through the second fluid communication port;

(f) actuating the shifting tool so as to move the second sleeve into a position whereby fluid flow through the second fluid communication port is terminated; wherein steps (d) through (f) are performed without removing the shifting tool from the wellbore; and (g) establishing fluid communication between at least one of the selected intervals and the liner through the at least one fines mitigation device.

2. The method according to claim 1, wherein steps (e) and (f) are performed after steps (c) and (d).

3. The method according to claim 1, wherein the shifting tool comprises an umbilical line disposed on an exterior surface of the liner which controls the actuation of the sleeves through electrical or hydraulic action.

4. The method according to claim 1, wherein the annular isolation device comprises one or more swellable packers.

5. The method according to claim 4, further comprising the step of exposing the one or more swellable packers to a reactive fluid which causes them to swell so as to form a seal between an exterior wall of the liner and the wellbore.

6. The method according to claim 5, wherein the step of exposing the one or more swellable packers to a reactive fluid comprises the step of introducing a spotting fluid into the well bore so as to contact the one or more swellable packers.

7. The method according to claim 1, further comprising the step of (h) actuating the shifting tool so as to move the second sleeve into a position whereby fluid flow through the second fluid communication port is permitted.

8. The method according to claim 7, wherein step (h) is performed after step (d) and prior to step (e).

9. The method according to claim 7, wherein steps (b) through (h) are performed in a single trip in the wellbore.

10. The method according to claim 1, wherein the fines mitigation device comprises a screen wrapped sleeve.

11. A method for multi-interval fracturing treatment comprising the steps of:

(a) introducing a multi-interval fracture treatment isolation assembly to a wellbore, the multi-interval fracture treatment isolation assembly comprising a liner, a first fluid communication port, a second fluid communication port, at least one sleeve having a baffle and being movable relative to the second fluid communication port, at least one fines mitigation device, and at least one annular isolation device coupled to the liner;

(b) activating the annular isolation device so as to provide zonal isolation to a plurality of selected intervals;

(c) delivering a fracturing treatment fluid to a first selected interval through the first fluid communication port;

(d) terminating fluid communication through the first fluid communication port;

(e) landing a plugging device on the baffle of the at least one sleeve so as to move the at least one sleeve into a position whereby a fracturing treatment fluid may be delivered to a second selected interval through the second fluid communication port;

(f) delivering a fracturing treatment fluid to the second selected interval through the second fluid communication port;

(g) terminating fluid communication through the second fluid communication port; and (h) establishing fluid communication between at least one of the selected intervals and the liner through the at least one fines mitigation device.

12. The method according to claim 11, wherein the annular isolation device comprises one or more swellable packers.

13. The method according to claim 11, further comprising the step of exposing the one or more swellable packers to a reactive fluid which causes them to swell so as to form a seal between an exterior wall of the liner and the wellbore.

14. The method according to claim 13, wherein the step of exposing the one or more swellable packers to a reactive fluid comprises the step of introducing a spotting fluid into the well bore so as to contact the one or more swellable packers.

15. The method according to claim 11, wherein the plugging device comprises a ball; and wherein steps (d) and (e) are performed simultaneously with the ball.

16. The method according to claim 11, wherein steps (b) through (h) are performed in a single trip in the wellbore.

17. The method according to claim 11, wherein the fines mitigation device comprises a screen wrapped sleeve.

18. The method according to claim 11, wherein the step of terminating fluid communication through the second fluid communication port comprises landing a second plugging device on a second baffle of a second sleeve so as to move the second sleeve into a position whereby fluid flow through the second fluid communication port is blocked.

* * * * *